US005303213A

United States Patent [19]

Kaelin

[11] Patent Number: 5,303,213

[45] Date of Patent: Apr. 12, 1994

[54] UNIDIRECTIONAL CORRECTION ARRANGEMENT FOR A TIME DISPLAYING DEVICE

[75] Inventor: Laurent Kaelin, Bienne, Switzerland

[73] Assignee: Eta SA Fabriques d'Ebauches, Granges, Switzerland

[21] Appl. No.: 943,705

[22] Filed: Sep. 11, 1992

[30] Foreign Application Priority Data

Sep. 11, 1991 [CH] Switzerland ..... 02671/91

[51] Int. Cl.[5] ..... G04B 19/24

[52] U.S. Cl. ..... 368/185; 368/190

[58] Field of Search ..... 368/190, 188, 185-199

[56] References Cited

U.S. PATENT DOCUMENTS

| | | | |
|---|---|---|---|
| 2,633,950 | 4/1953 | Phaneuf | 192/41 |
| 3,775,965 | 12/1973 | Besson et al. | 58/58 |
| 4,320,481 | 3/1982 | Hofert | 368/190 |
| 4,634,287 | 1/1987 | Vuilleumier et al. | 368/27 |

FOREIGN PATENT DOCUMENTS

| | | |
|---|---|---|
| 6600930 | 2/1969 | Fed. Rep. of Germany . |
| 290100 | 7/1953 | Switzerland . |
| 607556 | 8/1978 | Switzerland . |
| 2095438 | 9/1982 | United Kingdom . |

*Primary Examiner*—Bernard Roskoski
*Attorney, Agent, or Firm*—Griffin Butler Whisenhunt & Kurtossy

[57] ABSTRACT

This unidirectional correction arrangement (1) for a display device exhibiting a circular element (2) provided with teeth (3) includes a cylindrical element (4) around which is wrapped a helical spring (5), one of the ends of which serves as a finger (6) adapted to come into contact with a tooth (3). When the cylindrical element (4) is driven in rotation in a sense (A) for which the force (F1) exerted on the finger by the tooth is directed in a sense tending to wrap the spring around the cylindrical element and to tighten it therearound, the circular element (2) rotates. Such circular element (2) will not be driven when the cylindrical element (4) is driven so as to rotate in a sense (B) for which the force (F2) exerted on the finger by the tooth is directed in a sense tending to open the helical spring.

7 Claims, 5 Drawing Sheets

UNIDIRECTIONAL CORRECTION ARRANGEMENT FOR A TIME DISPLAYING DEVICE

The present invention concerns a unidirectional correction arrangement for at least one time displaying device in a timepiece, said time displaying device exhibiting a circular element provided with teeth.

BACKGROUND OF THE INVENTION

Unidirectional correction systems for a time displaying device are known. For example, patent document EP-B-0 173 230 (US-A-4 634 287) describes a universal timepiece including a date ring and a disc which are stepped every twenty-four hours. In accordance with whether the time setting stem is rotated in one sense or in the other, the indications given by the ring or respectively the indications given by the disc are corrected. The mechanism employed is a shifting intermediate wheel with teeth and a three-toothed pinion. If the stem is operated in one sense, the intermediate wheel is placed in a first position in which the teeth are in mesh with the disc. If the stem is operated in the opposite sense, the intermediate wheel is placed in a second position in which the pinion is in mesh with the ring. In such a construction, several wheel sets are interposed between the control stem and the time indicator which is to be corrected, this leading to a relatively complicated and difficult construction.

Patent document CH-A 607 556 has as its purpose to eliminate such wheel sets and to correct a date ring directly from a pinion sliding on the time setting stem. For this, the sliding pinion exhibits an annular groove in which is frictionally assembled a spring wire surrounding the groove over slightly more than three quarters of its periphery. A free end of the spring wire projects radially beyond the periphery of the sliding pinion and directly serves as driving finger in order to advance or draw back the date ring by turning the stem respectively in one or the other sense. Interesting though it may be, this construction does not lead to the solution proposed by the present invention, namely a unidirectional correction arrangement since the spring wire of the cited document acts on the date ring in both correction senses. This is a bidirectional arrangement.

Patent document CH-A-290 100 describes a unidirectional control system for winding up an alarm device. On the winding stem are mounted, one following the other, two sockets of the same diameter on which a helical spring is wound. One of the sockets is fixed to the stem while the other is free to rotate on such stem. The free socket is fixed to a toothed wheel, itself fixed to a barrel spring. When the stem is driven in rotation in one sense, the helical spring is tightened around both sockets in order to couple them together and thus wind the barrel spring. When the stem is driven in rotation in the other sense, the helical spring is loosened and the free socket is not driven. There, however, it concerns a coupling system in which the helical spring may act only if it encloses two elements (two sockets) placed side by side, which has nothing in common with the present invention in which the helical spring encloses only a single element (a sliding pinion) and where such spring exhibits a raised end which drives a second element (a date disc).

The interest in a unidirectional correction system may be seen in the economy of the means employed when it concerns the correction of an entire series of time indicators as is evoked in the first document cited hereinabove: when the stem is rotated in one sense, the data is corrected for one indicator and when the stem is rotated in the other sense, the data is corrected for another indicator. Another interest may be seen quite plainly in the simplification which it brings to the driving mechanism for the indicator in question. It is known, for example, that the driving mechanism may give rise to problems of good operation if the time indicator can be manually corrected in both senses.

SUMMARY OF THE INVENTION

To respond to these questions and to avoid the cited difficulties, the unidirectional correction arrangement of the present invention is characterized in that it includes a cylindrical element around which is wrapped a lightly tightened cylindrical spring, one of the ends of which is radially raised in order to serve as finger adapted to come into contact with a tooth of the circular element and to cause it to rotate when said cylindrical element is driven in rotation in a sense for which the force exerted on the finger by the tooth is directed in a sense tending to wrap the helical spring around the cylindrical element and to tighten it thereabout, said circular element remaining stationary when the cylindrical element is driven in rotation in a sense for which the force exerted on the finger by the tooth is directed in a sense tending to open the helical spring and to free it from said cylindrical element.

The invention will now be explained with the help of the following description given by way of example and in referring to the drawings which illustrate it.

DESCRIPTION OF THE PREFERRED EMBODIMENT

Figure 1:
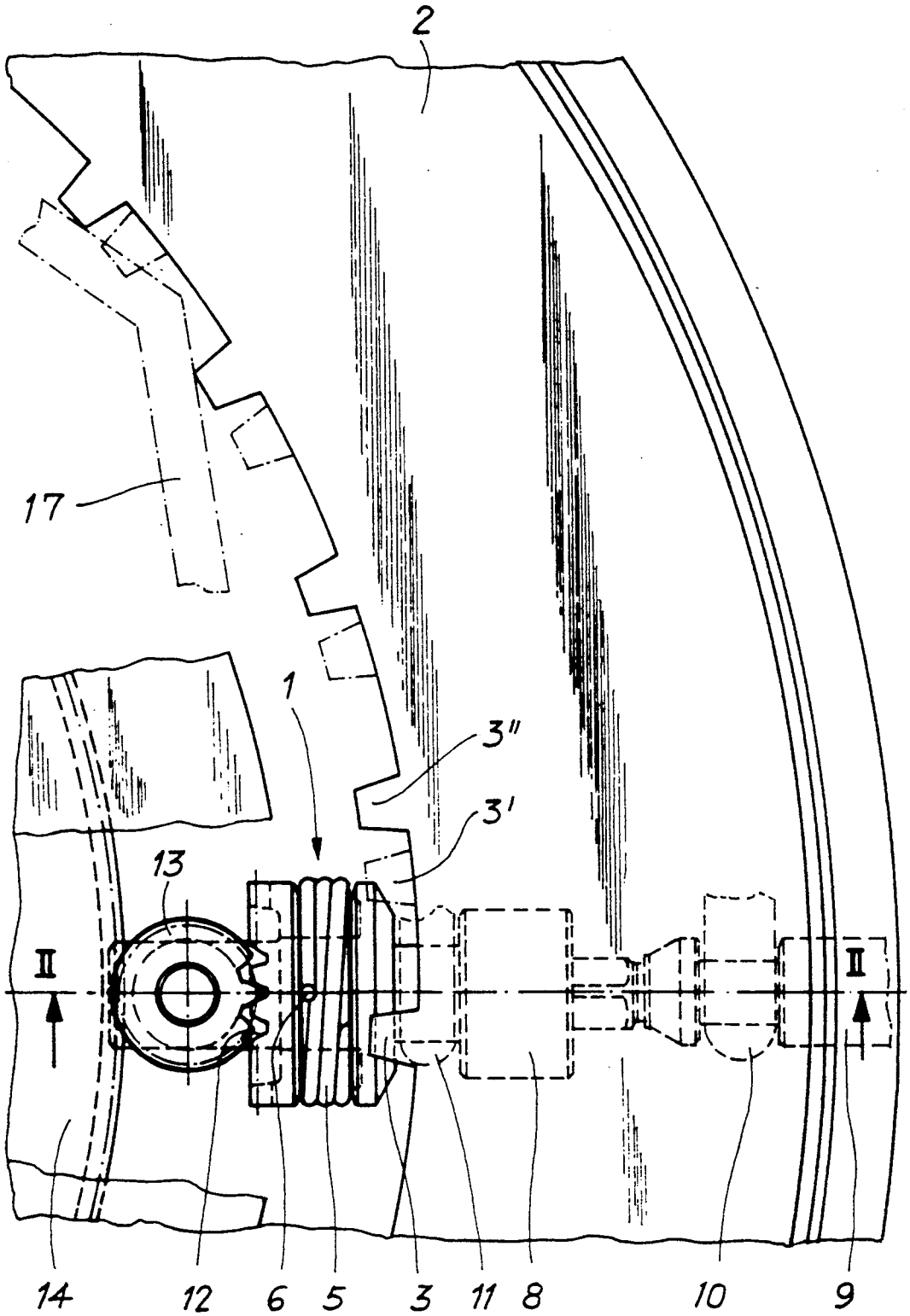
FIG. 1 is a plan view of the arrangement according to the invention, stem and sliding pinion being shown in the time setting position for the hour and minute indicators, the stem being placed in the second drawn-out position.
Figure 4:
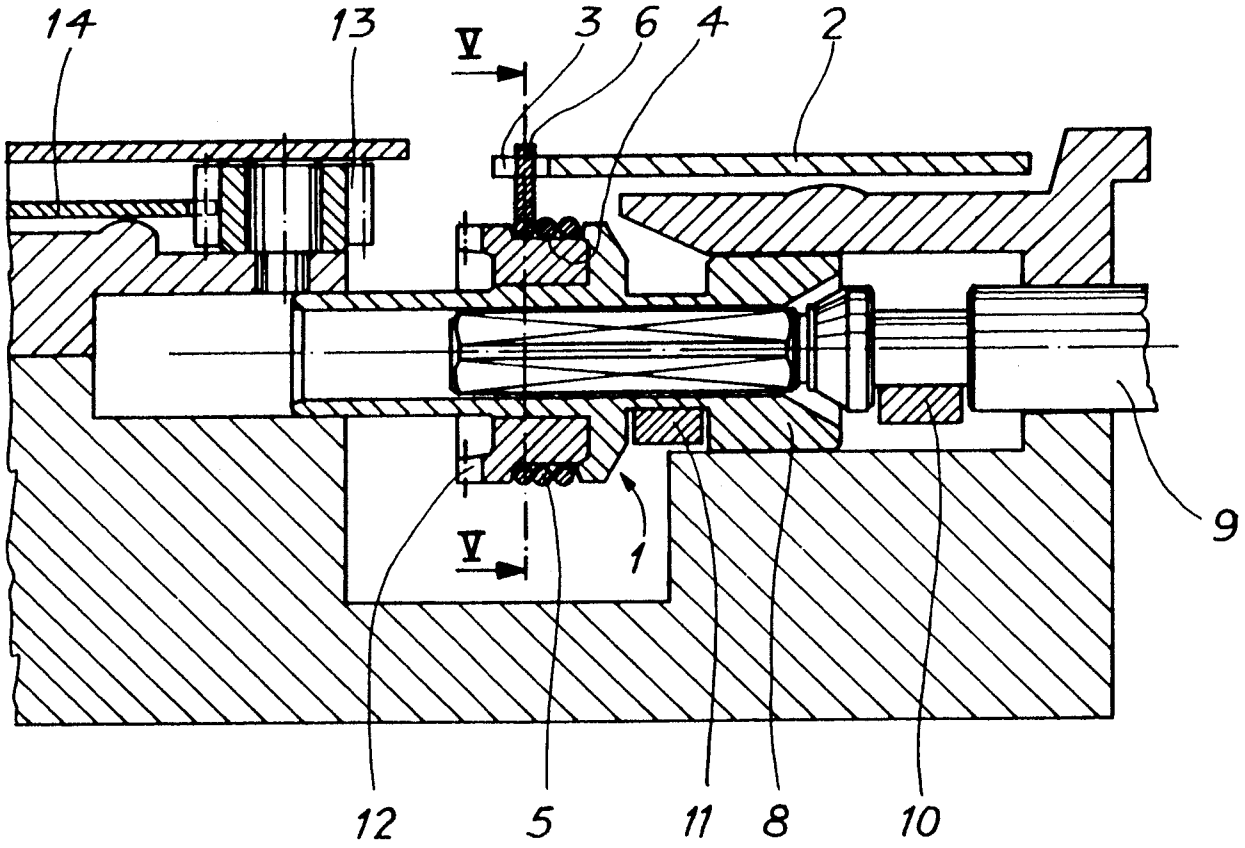
FIG. 4 is a cross-section along line II—II of FIG. 1 in supposing the stem and sliding pinion in the position for correcting the date indicator, the stem being then in the first drawn-out position.

FIGS. 1 and 4 show a unidirectional correction arrangement adapted to correct a time display device exhibiting a circular element 2 provided with teeth 3. In accordance with the invention, the correction arrangement 1 includes a cylindrical element 4 around which is wrapped a lightly tightened helical spring 5. One of the ends of such spring is radially raised in order to serve as drive finger 6.

Figure 6:
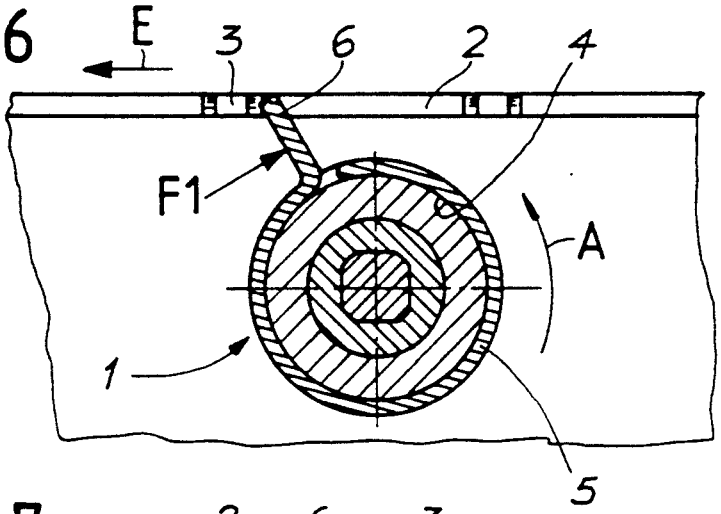
FIG. 6 shows the displacement of the arrangement of FIG. 5 in the sense of arrow A.

As is seen on FIG. 6, such finger 6 is adapted to come into contact with a tooth 3 of the circular element 2 and to cause such element to rotate in the sense of arrow E when the cylindrical element 4 is driven in rotation in the sense of arrow A. Effectively, the resistance exerted by tooth 3 against finger 6 develops a reaction force F1 tending to wrap the helical spring 5 about the cylindrical element 4 and to tighten it thereabout. It can be said that the helical spring is locked around the cylindrical element to which it becomes fixed.

Figure 7:
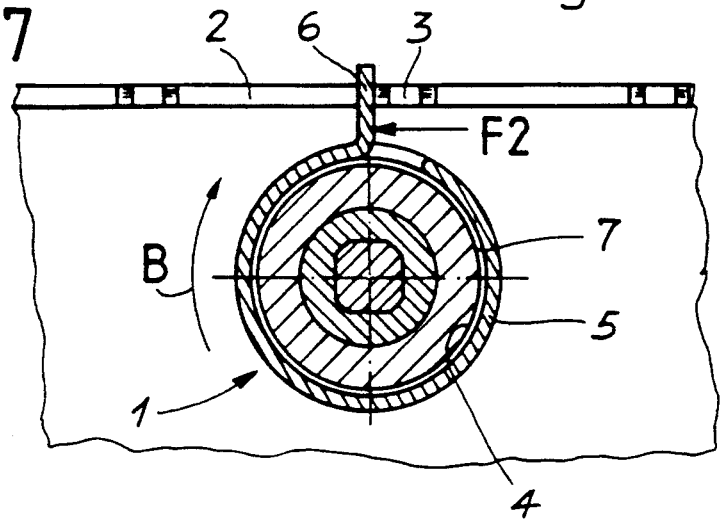
FIG. 7 shows the displacement of the arrangement of FIG. 5 in the sense of arrow B.

If now FIG. 7 is considered and the cylindrical element 4 is actuated in the sense of arrow B, that is to say, in the sense opposite to that considered in FIG. 6, it is seen that when finger 6 bears on tooth 3, reaction force F2 exerted on finger 6 has a tendency to open the helical spring 5 and to free it from the cylindrical element 4, such situation being symbolized by the space 7 which has been drawn between element 4 and helical spring 5. Spring 5 then slips on element 4 and the circular element 2 remains stationary.

As a conclusion to what has just been said, there has been fashioned a unidirectional correction system since the time indicator 2 is advanced if arrangement 1 is rotated in one sense, such indicator remaining stationary if the arrangement is rotated in the inverse sense. The principle of the invention is very general and may be very easily verified by placing on a stem a helical spring, the interior diameter of which is very slightly less than the diameter of the stem, and one of the ends of which is raised along a radius of the stem in order to form a drive finger. The arrangement may be usefully employed in a timepiece, in particular for manual correction of various time indicators. It is however clear that it could be employed anywhere where a unidirectional control is desired.

There will now be given an example of application of the invention to a correction arrangement for a date ring bearing date indications which appear through an opening pierced in a dial.

Figure 2:
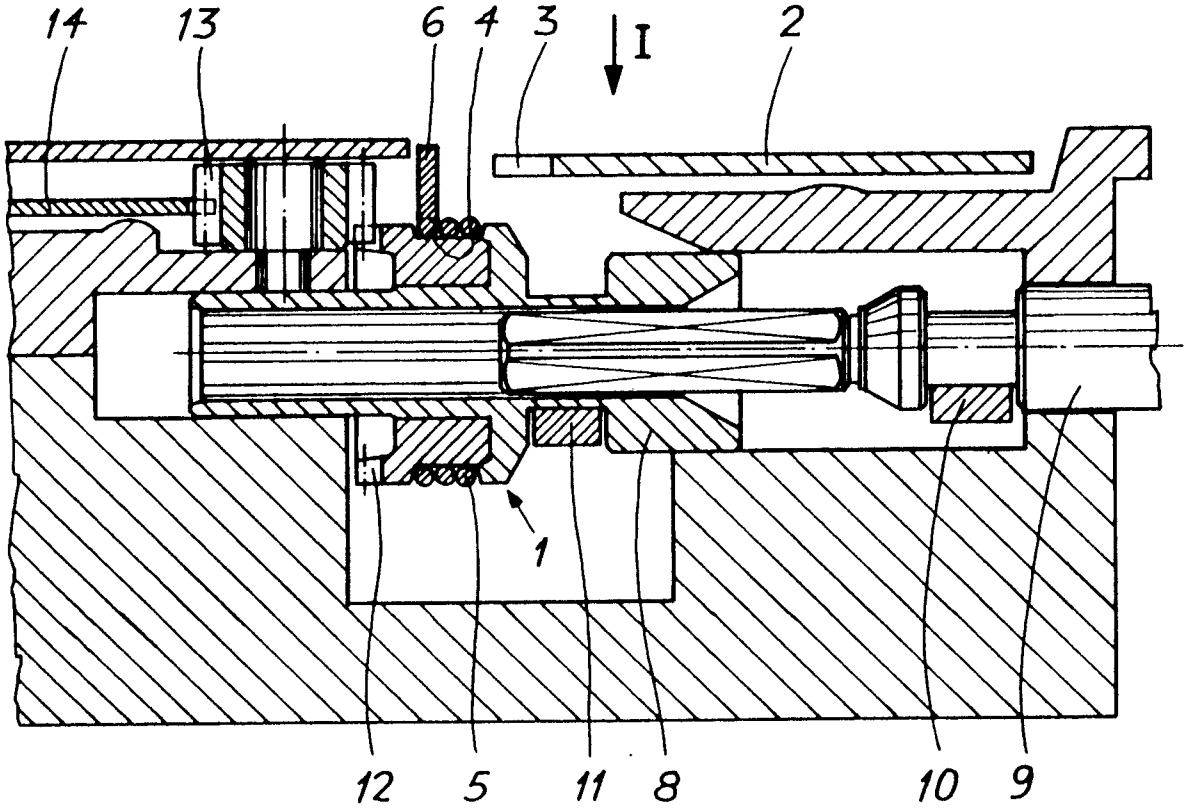
FIG. 2 is a cross-section along line II—II of FIG. 1.

If reference is made to FIGS. 1 and 2, it will be noticed that the cylindrical element 4 around which the helical spring 5 is wrapped is carried by a sliding pinion 8 cooperating with a time setting stem 9. Relative movement of the stem with respect to the sliding pinion 8 is brought about by a mechanism known elsewhere and including in particular a trigger piece 10 and a rocking lever 11. The sliding pinion comprises contrate teeth 12 meshing here with an intermediate wheel 13, this latter meshing with a minute wheel 14. Stem 9 is drawn out to the maximum and occupies a second withdrawn position which permits time setting of the hours and minutes hands of the timepiece. Finger 6 of the helical spring 5 is not engaged in teeth 3 of the circular element 2 which here is a date ring with interior teeth well known in the state of the art.

FIG. 4 shows a stem 9 occupying a first drawn-out position which permits correction of the date ring 2. For this finger 6 of the helical spring 5 is engaged in the teeth 3 of the ring. This situation is also shown on FIG. 5 which is a cross-section along line V—V of FIG. 4.

Assuming the situation shown on FIG. 5, if the correction arrangement 1 is rotated in the sense of arrow A, the back 15 of finger 6 will strike tooth 3 on its face 16 and will drive said tooth until it attains the position illustrated on FIG. 6, this thanks to the tightening principle of the helical spring explained hereinabove. From this moment ring 2 will not have advanced an entire step in the construction here adopted, but will have run through about three quarters of the travel. As appears on FIG. 1, tooth 3 will be displaced to 3', the remainder of the travel from 3' to 3'' being brought about thanks to the presence of a jumper spring 17.

Figure 5:
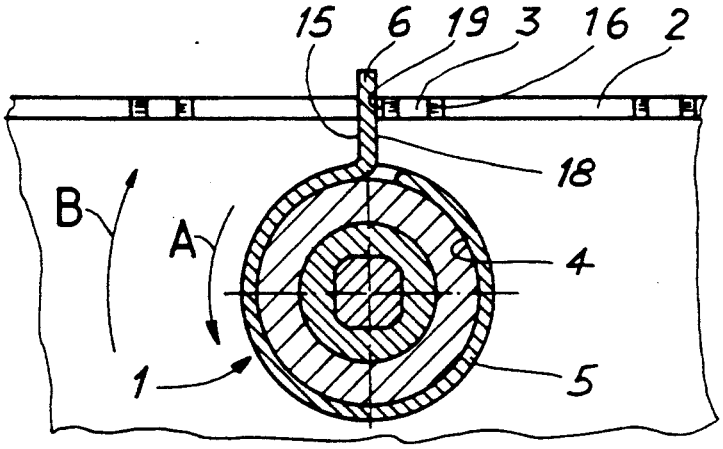
FIG. 5 is a cross-section along line V—V of FIG. 4.

In the same manner, from the situation shown on FIG. 5, if arrangement 1 is rotated in the sense of arrow B, the front 18 of finger 6 will strike tooth 3 on its face 19 as is shown on FIG. 7. In this case, spring 5 opens up and the ring rests stationary as explained hereinabove.

Figure 3:
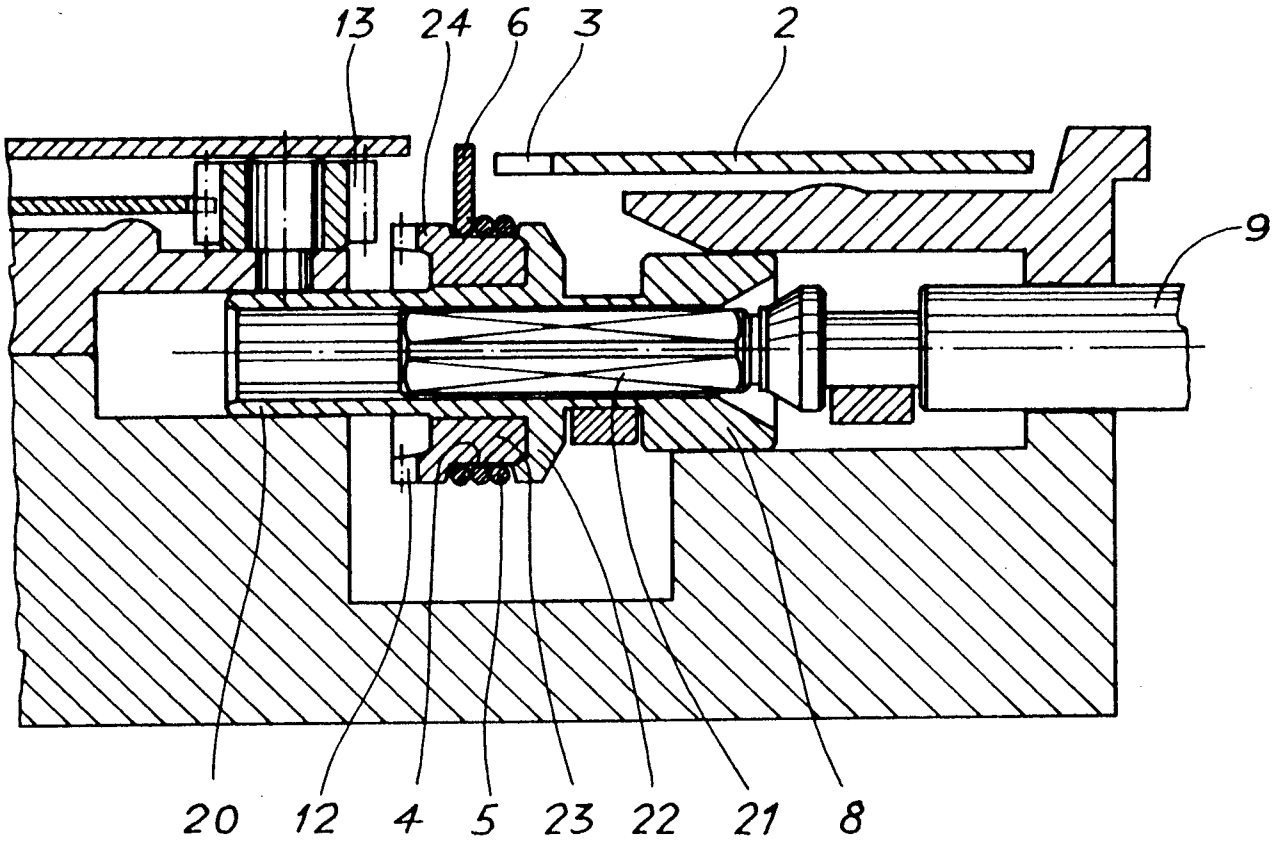
FIG. 3 is a cross-section along line II—II of FIG. 1 in supposing the stem and sliding pinion in the neutral position, the stem being then in the pushed-in position.

FIG. 3 shows stem 9 in the neutral pushed-in position. Here no correction is brought about since finger 6 is not engaged in teeth 3 of ring 2 and the teeth 12 of the sliding pinion 8 do not mesh with the intermediate wheel 13.

FIG. 3 enables explaining also the manner in which the sliding pinion 8 is formed. The latter is made in two parts driven into one another. The first part includes a hub 20 in which slides a squared-off portion 21 ending stem 9. The first part, in addition, bears a flange 22 preferably integrally formed with the hub. The second part includes the toothed pinion 24 as such, bearing the contrate teeth 12. This pinion is extended by a collar 23 which forms cylindrical element 4 which in turn bears the helical spring 5. FIG. 3 shows that the outer diameter of collar 23 is smaller than the diameter of the toothed pinion 24 and of flange 22 so that the helical spring 5 is maintained axially in place between the two parts forming the sliding pinion. This construction by driving is above all interesting in order to permit assembly of the helical spring 5 which is slid on over collar 23 before the two parts in question are assembled.

According to a characteristic of the invention, helical spring 5 is wrapped lightly tightened around the cylindrical element 4. Such tightening is obtained by providing a spring the interior diameter of which is slightly less than the diameter of the cylindrical element. In the construction shown as example in FIG. 3, the outer diameter of collar 23 is 3.6 mm while the diameter of the helical spring 5 is 3.5 mm prior to assembly on the collar.

It will be further noted that the locking couple of the helical spring onto the cylindrical element depends on the number of turns making up the spring and, to a certain degree, the diameter of the wire used for manufacturing the spring. A spring formed with wire of 0.15 mm and including three turns has given excellent results.

The correction arrangement according to the invention acting in a unidirectional manner, it is possible to conceive a double arrangement which, for a drawn-out position of the stem, may correct two different time indicators, one for example indicating the date and the other the week day, and this in accordance with the rotation sense of the stem. It is sufficient for this to have available two helical springs, one wrapped in one sense and correcting the date, and the other wrapped in the other sense and correcting the week day.

What I claim is:

1. A unidirectional correction arrangement for at least one time displaying device in a timepiece, said display device having a circular element provided with teeth, comprising: a cylindrical element, a lightly tightened helical spring wrapped around the cylindrical element, the spring having two ends, one of which ends is radially raised so as to serve as a finger adapted to come into contact with a tooth of the circular element and to cause the circular element to rotate only when said cylindrical element is driven in a first sense (A) of rotation for which a force exerted on the finger by the tooth is directed in a sense tending to wrap the helical spring around the cylindrical element and to tighten it thereabout, said circular element remaining stationary when the cylindrical element is driven in a second sense (B) of rotation for which the force exerted on the finger by the tooth is directed in a sense tending to open the helical spring and to free it from said cylindrical element.

2. An arrangement as set forth in claim 1 wherein the cylindrical element is carried by a sliding pinion, a time setting stem cooperating with the pinion and means including a trigger piece and a rocking lever adapted to cause movement of the stem relative to the pinion.

3. An arrangement as set forth in claim 2 wherein the stem can be axially positioned in at least one drawn-out position relative to a pushed-in rest position, the drawn-out position engaging the finger of the helical spring in the teeth of the circular element.

4. An arrangement as set forth in claim 2 wherein the sliding pinion has teeth and is formed in two parts driven into one another, the first part including a hub in which the stem slides and a flange integrally formed with the hub, the second part including the pinion extended by a collar forming said cylindrical element, the collar having an outer diameter which is smaller than the diameter of said pinion and of said flange to permit assembly of said helical spring and to maintain it in place axially when said two parts are driven into one another.

5. An arrangement as set forth in claim 1 wherein the circular element comprises a ring provided with interior teeth on which said finger acts, said ring bearing date indications visible through a dial opening.

6. An arrangement as set forth in claim 5 wherein a jumper spring cooperates with said inner teeth to complete rotation of the ring once the tooth on which the finger acts is no longer driven by said finger.

7. An arrangement as set forth in claim 1 wherein the helical spring counts at least three turns.

* * * * *